US005929622A

United States Patent [19]

Kardash

[11] Patent Number: 5,929,622

[45] Date of Patent: Jul. 27, 1999

[54] BALANCED CURRENT MIRROR

[75] Inventor: John Kardash, Gilroy, Calif.

[73] Assignee: Quantum Corporation, Milpitas, Calif.

[21] Appl. No.: 09/108,927

[22] Filed: Jul. 1, 1998

[51] Int. Cl.[6] ..... G05F 3/16

[52] U.S. Cl. ..... 323/315; 323/313; 323/314

[58] Field of Search ..... 323/315, 314, 323/312, 313, 316; 330/257, 259, 260; 307/350

[56] References Cited

U.S. PATENT DOCUMENTS 5,010,303 4/1991 Braun ..... 330/257

5,432,432 7/1995 Kimura ..... 323/313

*Primary Examiner*—Peter S. Wong

*Assistant Examiner*—Rajnikant B. Patel

*Attorney, Agent, or Firm*—Michael Zarrabian

[57] ABSTRACT

A current mirror circuit comprising a first controller for providing a first current path, the controller comprising a current reference means for providing a control signal corresponding to the current level of the first current path; a second controller for providing a second current path, the second controller comprising current control means for controlling the level of current through the second current path in response to the control signal; and a balancing circuit, connected in series with said current reference means in the first current path and with said current control means in the second current path, for maintaining a ratio of the level of currents through the first and the second current paths by providing substantially the same relative reference voltage level at first and second locations in said first and second current paths, respectively, while allowing said reference voltage level to vary. The balancing circuit provides substantially the same impedance in the current paths at said first and second reference locations to maintain the same relative reference voltage level at said first and second reference locations in said current paths while allowing said reference voltage level to vary.

32 Claims, 6 Drawing Sheets

BALANCED CURRENT MIRROR

FIELD OF THE INVENTION

The present invention generally relates to current mirrors and, in particular, to a balanced current mirror.

BACKGROUND

A current mirror is typically assembled from two transistors such as bipolar transistors or MOSFET transistors. For example, a current mirror can be constructed from two PNP transistors Q1 and Q2, where the collectors of the transistors Q1 and Q2 are commonly connected to a voltage potential such as ground, and the emitters of the transistor Q1 and Q2 are tied to a voltage potential $V_{CC}$. The bases of the transistors Q1 and Q2 are connected in common with the collector of the transistor Q1 generally acting as an input current path while the collector of the transistor Q2 effectively acts as an output current path. Connecting the base and collector of the transistor Q1 results in the transistor Q1 operating in its active region and accepting any desired level of current.

Sinking a current from the collector of the transistor Q1 "programs" the current mirror and causes a voltage difference $V_{BE}$ between the base and emitter of the transistor Q1. Since the transistors Q1 and Q2 have the same base bias potential and relative base to emitter potential difference, the transistor Q2 is thereby programmed to source or "mirror" the same current through its collector. The current sourced by the transistor Q2 depends on the relative transconductance of the transistors Q1 and Q2. If the transistors Q1 and Q2 are well matched, the output current path of the current mirror will draw a current level the same as that of the input current path. In that case, the ratio of input to output current is equal to one. The ratio of the input to output current can be selected based on the ratio of the transconductances of the transistor Q1 and Q2.

In conventional mirrors however, the currents in the input and output current paths of the mirrors do not mirror correctly because the voltage at one current path can be different from the voltage at the other current path. For example, when the voltage at the output current path varies, the voltage at the input current path remains fixed, causing an imbalance in the relative voltage level between the two current paths. The change in the output voltage causes the output current to vary due to the finite output impedance of the current mirror. In the above example, a change in the collector voltage of the transistor Q2 in the output current path at a given current level causes a variation in $V_{BE}$ for the transistor Q2 due to the "Early" effect. This is because the curve of collector current versus collector-emitter voltage $V_{CE}$ at a fixed base-emitter voltage $V_{BE}$ is not flat. As such, the output current might vary substantially over the range of the output voltage of the mirror at the collector of the transistor Q2.

To alleviate this problem, some current mirrors include fixed biasing means for keeping the output voltage at a fixed level. For example, such a current mirror can be constructed from three PNP transistors Q1, Q2 and Q3, where the bases of the transistors Q1 and Q2 are connected in common with the collector of the transistor Q2, and the base of the transistor Q3 is connected to the collector of the transistor Q1. The collector of the transistor Q2 is connected to the emitter of the transistor Q3, and the emitters of the transistors Q1 and Q2 are connected to a voltage potential such a $V_{CC}$. As such, the transistor Q3 keeps the collector of the transistor Q1 fixed at two diode drops below $V_{CC}$, circumventing the Early effect in the transistor Q1. Sinking a desired input current through the collector of the transistor Q1 causes the transistor Q2 to mirror an output current through its collector. Both the current-determining transistors Q1 and Q2 have fixed collector-emitter drops. However, a major disadvantage of such current mirrors is that although the currents in the input and output paths remain balanced, the voltage at the input and output paths cannot vary, and only coupling of currents is permitted.

There is, therefore, a need for a balancing controller for balancing mirror currents in a current mirror while allowing the relative voltage on the current paths of the mirror to vary.

SUMMARY

The present invention satisfies these needs. In one embodiment, the present invention provides a balancing controller for balancing mirror currents in a current mirror circuit. The current mirror circuit includes a first controller for providing a first current path, the first controller comprising a current reference means for providing a control signal corresponding to the current level of the first current path, and a second controller for providing a second current path, the second controller comprising current control means for controlling the level of current through the second current path in response to the control signal. The balancing controller comprises a balancing circuit, connected in series with the current reference means in the first current path and with the current control means in the second current path, for substantially maintaining a ratio of the level of currents through the first and the second current paths by providing substantially the same relative reference voltage level at first and second reference locations in the first and second current paths, respectively, while allowing the reference voltage level to vary.

The balancing circuit provides substantially the same impedance at the first and second reference locations in the first and second current paths to substantially maintain the same relative reference voltage level at said first and second reference locations while allowing the reference voltage level to vary. The balancing circuit can comprise a first transistor in series with the current reference means in the first current path, and a second transistor in series with the current control means in the second current path, the second transistor coupled to the first transistor for substantially maintaining the ratio of the current levels through the first and the second current paths by providing said relative reference voltage level while allowing the reference voltage level to vary. Preferably, the first and the second transistors of the balancing circuit are biased so as to operate in their respective saturation regions.

In another embodiment, the present invention provides a current mirror circuit comprising a first controller for providing a first current path, the controller comprising a current reference means for providing a control signal corresponding to the current level of the first current path; a second controller for providing a second current path, the second controller comprising current control means for controlling the level of current through the second current path in response to the control signal, and a balancing circuit, connected in series with said current reference means in the first current path and with said current control means in the second current path, for substantially maintaining a ratio of the level of currents through the first and the second current paths by providing substantially the same relative reference voltage level in the current paths while allowing the reference voltage level to vary. The balancing circuit provides substantially the same impedance in the current paths to substantially maintain the same relative reference voltage level in the current paths while allowing the reference voltage level to vary.

The first controller can comprise a first transistor having first, second and control terminals, where the control terminal provides a control signal corresponding to the current level of the first current path. The second controller can comprise a second transistor having first, second and control terminals, where the control terminals of the first and the second transistor are coupled to one another for controlling the level of current through the second current path in response to the control signal. The balancing circuit can comprise a pair of input tenninals and a pair of corresponding output terminals, provided in series in the first and second current paths by connecting one of the input terminals to the second terminal of the first transistor in the first current path and connecting the other input terminal to the second terminal of the second transistor in the second current path.

In one embodiment, the balancing circuit can further comprise third and fourth transistors each having first, second and control terminals. The first and second terminals of the third transistor are connected in series with one of said input terminals and the corresponding output terminal in the first current path, respectively. The first and second terminals of the fourth transistor are connected in series with another of said input terminals and the corresponding output terminal in the second current path, respectively. The control terminals of the third and the forth transistors are coupled in common to the first terminal of the fourth transistor for substantially maintaining the ratio of the current levels through the first and the second current paths by providing the relative reference voltage level while allowing the reference voltage level to vary. Preferably, the third and the fourth transistors of the balancing circuit are biased so as to operate in their respective saturation regions.

The current mirror can further comprise a current sink; a first current control circuit provided in the first current path in series between the balancing circuit and the current sink, for adjusting the level of current flowing through the first current path in response to a first command signal; and a second current control circuit provided in the second current path in series between the balancing circuit and the current sink, for adjusting the level of current flowing through the second current path in response to a second command signal. Each of the first and second current control circuits has an impedance varying with voltage, wherein the balancing circuit matches the impedance of the current control circuits by substantially maintaining the relative reference voltage level at the output terminals in the current paths while allowing the reference voltage level to vary. The first and second current control circuits can each comprise transistors having substantially similar transconductances and impedances varying with voltage. The balancing circuit matches the impedance of the transistors by substantially maintaining the reference voltage at said output terminals.

DRAWINGS

These and other features, aspects and advantages of the present invention will become better understood with regard to the following description, appended claims and accompanying drawings where:

DESCRIPTION

Figure 1:
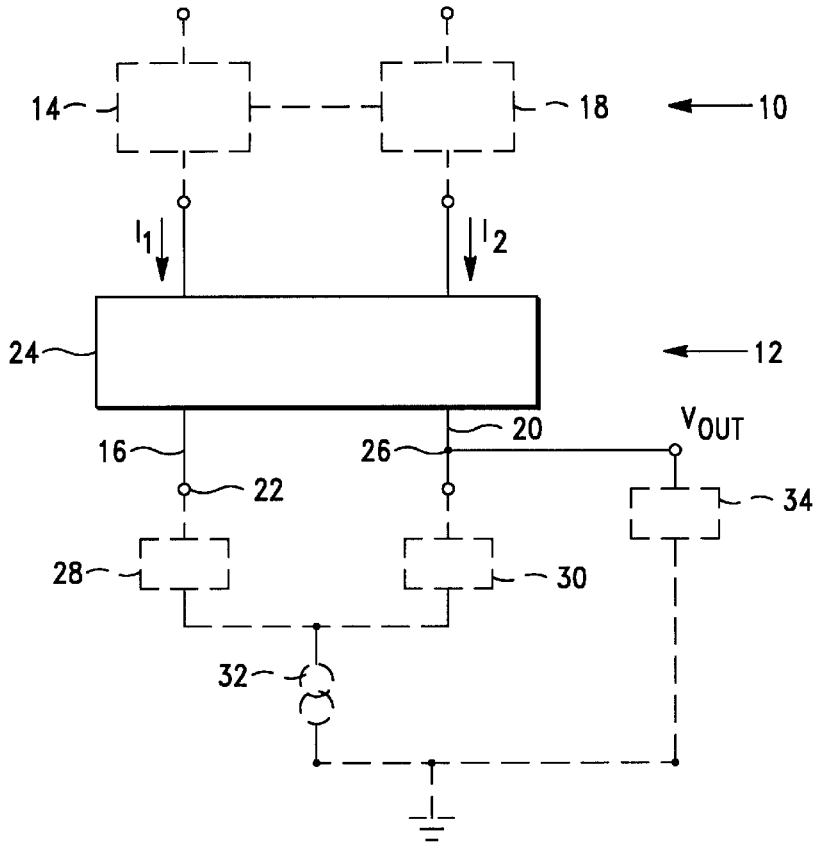
FIG. 1 is a block diagram of an embodiment of a balancing controller according to the present invention interconnected to example an current mirror circuit, active loads and a current sink.

FIG. 1 shows a block diagram of an example current mirror circuit 10 to which an embodiment of a balancing controller 12 according to the present invention is interconnected. The current mirror circuit 10 comprises a first controller 14 for providing a first current path 16 carrying a first current $I_1$, and a second controller 18 for providing a second current path 20 carrying a second current $I_2$. The balancing controller 12 comprises a balancing circuit 24 connected in series with the first and second controllers 14, 18 for maintaining a substantially constant ratio $R=I_1/I_2$ of the level of currents through the first and the second current paths 16, 20 by providing substantially the same relative reference voltage level $V_{OUT}$ at first and second reference locations 22, 26 in the first and second current paths 16, 20, respectively, while allowing the reference voltage level $V_{OUT}$ to vary. The balancing circuit 24 can be interconnected to loads 28, 30 and a current sink 32, where the reference voltage level potential $V_{OUT}$ is provided by a variable voltage load 34.

Figure 2:
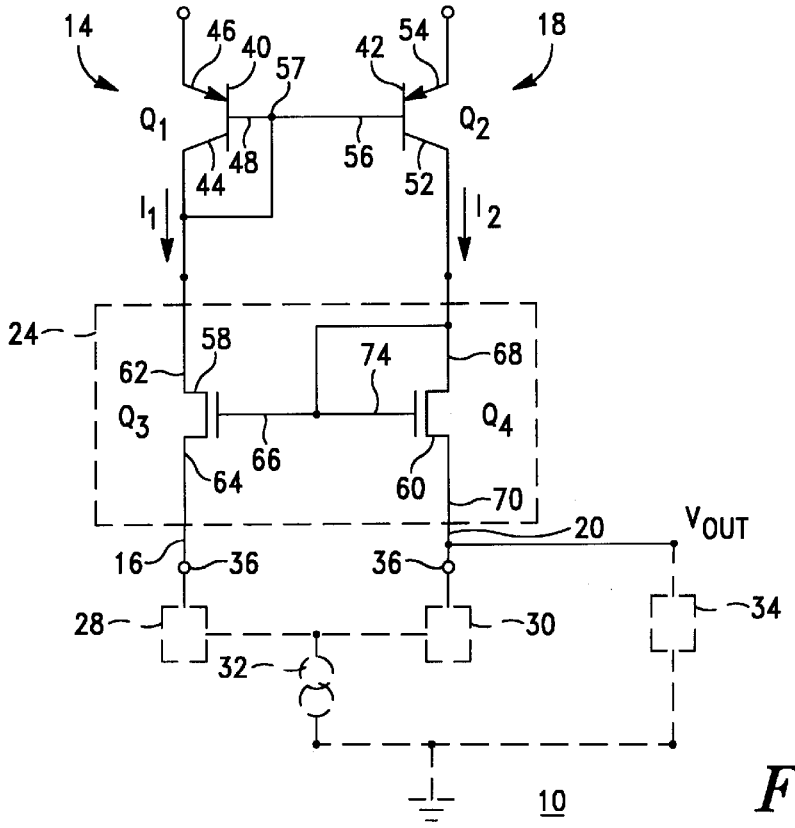
FIG. 2 is a schematic diagram of the block diagram of FIG. 1.

FIG. 2 shows a schematic diagram of an example implementation of the current mirror circuit 10 and the balancing circuit 24 of FIG. 1. The first controller 14 comprises a current reference means 40 for providing a control signal corresponding to the current level of the first current path 16. The second controller 18 comprises a current control means 42 for controlling the level of current through the second current path 20 in response to the control signal from the current reference means 40 . The balancing circuit 24 provides substantially the same impedance at reference locations 36, 38 in the first and second current paths 16, 20, respectively, to maintain the same relative reference voltage level $V_{OUT}$ at reference locations 36, 38 in the current paths 16, 20 while allowing the reference voltage $V_{OUT}$ level to vary.

In the example embodiment shown in FIG. 2, the current reference means 40 comprises a PNP transistor indicated as Q1, and the current control means 42 comprises a PNP transistor indicated as Q2. Although in the example embodiment described herein, the transistors Q1 and Q2 comprise bipolar transistors, other transistor types such as Field Effect Transistors can also be utilized. The transistor Q1 includes collector, emitter and base terminals 44, 46, 48, respectively, where the base 48 of the transistor Q1 provides the control signal corresponding to the current level of the first current path 16. The transistor Q2 includes collector, emitter and base terminals 52, 54, 56, respectively, where the base terminals 48, 56 of the transistors Q1 and Q2 are coupled to one another at node 57 for controlling the level of current through the second current path 20 in response to the control signal. The base terminals 48, 56 of the transistors Q1 and Q2 are also connected in common with the collector 44 of the transistor Q1 generally acting as an input current path while the collector 52 of the transistor Q2 effectively acts as an output current path.

Connecting the base 48 and the collector 44 of the transistor Q1 results in the transistor Q1 operating in its active region and accepting any desired level of current through its collector 44. Sinking a current $I_1$ from the collector 44 of the transistor Q1 causes a voltage difference $V_{BE}$ between the base 48 and the emitter 46 of the transistor Q1. Since the transistors Q1 and Q2 have the same base bias potential and relative base to emitter potential difference, the transistor Q2 sources a current $I_2$ equal to $I_1$ through its collector 52. The level of current $I_2$ sourced by Q2 depends on the relative transconductances of the transistors Q1 and Q2. If the transistor Q1 and Q2 are well matched, then $I_1$ and $I_2$ will be equal. In that case, the ratio R of input to output currents $I_1/I_2$ is equal to one. As such, the ratio R can be selected based on the ratio of the transconductances of the transistor Q1 and Q2.

In the example embodiment shown in FIG. 2, the balancing circuit 24 comprises two n-channel MOSFET transistors 58, 60 indicated as Q3 and Q4 respectively. The transistor Q3 includes drain, source and gate terminals 62, 64, 66, respectively, and the drain 62 of the transistor Q3 is connected to the collector 44 of the transistor Q1 in the first current path 16. The transistor Q4 includes drain, source and gate terminals 68, 70, 74, respectively, and the drain 68 of the transistor Q4 is connected to the collector 52 of the transistor Q2 in the second current path 20. The gate control terminals 66, 74 of the transistors Q3 and Q4, respectively, are coupled in common to the drain 68 of the transistor Q4.

Due to the common gate to drain connection, the transistor Q4 operates in its saturation region. Therefore, the current $I_2$ established by the transistor Q2 flows from the drain 68 to the source 70 of the transistor Q4 through the second current path 20. Since the transistors Q3 and Q4 share a common gate voltage potential, the transistor Q3 will tend to accept the same level of current $I_1$ as the transistor Q4 through the first current path 16. The transistors Q3 and Q4 are biased to operate in their saturation regions. By matching the transconductances of the transistors Q1 and Q2 the levels of $I_1$ and $I_2$ can be equal.

The source 70 of the transistor Q4 provides the output node 38 for coupling the variable voltage load 34. The reference voltage level $V_{OUT}$ at the source 70 of the transistor Q4 can vary freely depending on the output voltage variations, and the voltage level at the source 64 of the transistor Q3 follows that of the transistor Q4. As shown in FIG. 2, the transistor Q4 is arranged in a diode configuration in the second current path 20 and the transistor Q3 is arranged as a cascode in the first current path 16. The transistors Q3 and Q4 have the same gate to source voltage drop since they carry the same currents $I_1$ and $I_2$, respectively, from drain to source and have a common gate connection. The voltage level at the gate 74 of the transistor Q4 is one diode drop above the voltage level at the source 70 of the transistor Q4. The transistor Q3 is configured as a source follower and reflects the same voltage drop as the diode transistor Q4. Therefore, the voltage level at the source 64 of the transistor Q3 is the same as the voltage level at the source 70 of the transistor Q4. As such, the balancing circuit 24 can maintain a desired ratio R of currents $I_1/I_2$ while allowing the output voltage $V_{OUT}$ to vary. This allows coupling of both voltages and currents to the balancing circuit 24 and the loads 28, 30.

Figure 3:
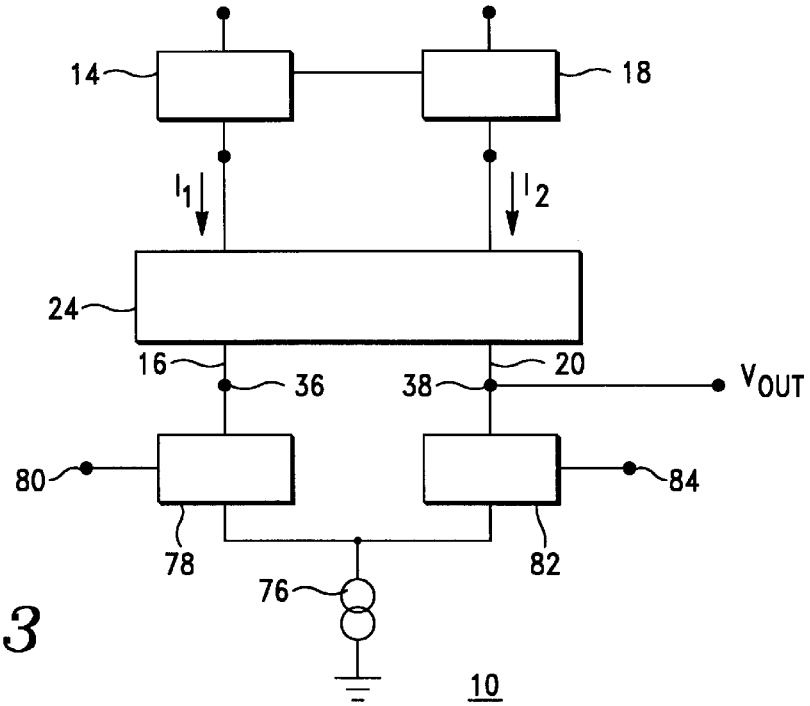
FIG. 3 is a block diagram of an embodiment of a current mirror circuit according to another aspect of the present invention.

FIG. 3 shown a block diagram of the balancing circuit 24 of FIG. 1, interconnected to: (1) a current sink 76, (2) a first current control circuit 78 provided in the first current path 16 in series between the balancing circuit 24 and the current sink 76, for adjusting the level of current flowing through the first current path 14 in response to a first command signal at node 80 and (3) a second current control circuit 82 provided in the second current path 20 in series between the balancing circuit 24 and the current sink 76, for adjusting the level of current flowing through the second current path 20 in response to a second command signal at node 84. Each of the first and second current control circuits 78, 82 has an impedance varying with voltage. However, the balancing circuit 24 matches the impedance of the current control circuits 78, 82 by maintaining a relative reference voltage level $V_{OUT}$ at the output terminal 38 in the second current path 20 and the corresponding node 36 in the first current path 16 while allowing the reference voltage level $V_{OUT}$ to vary.

Figure 4:
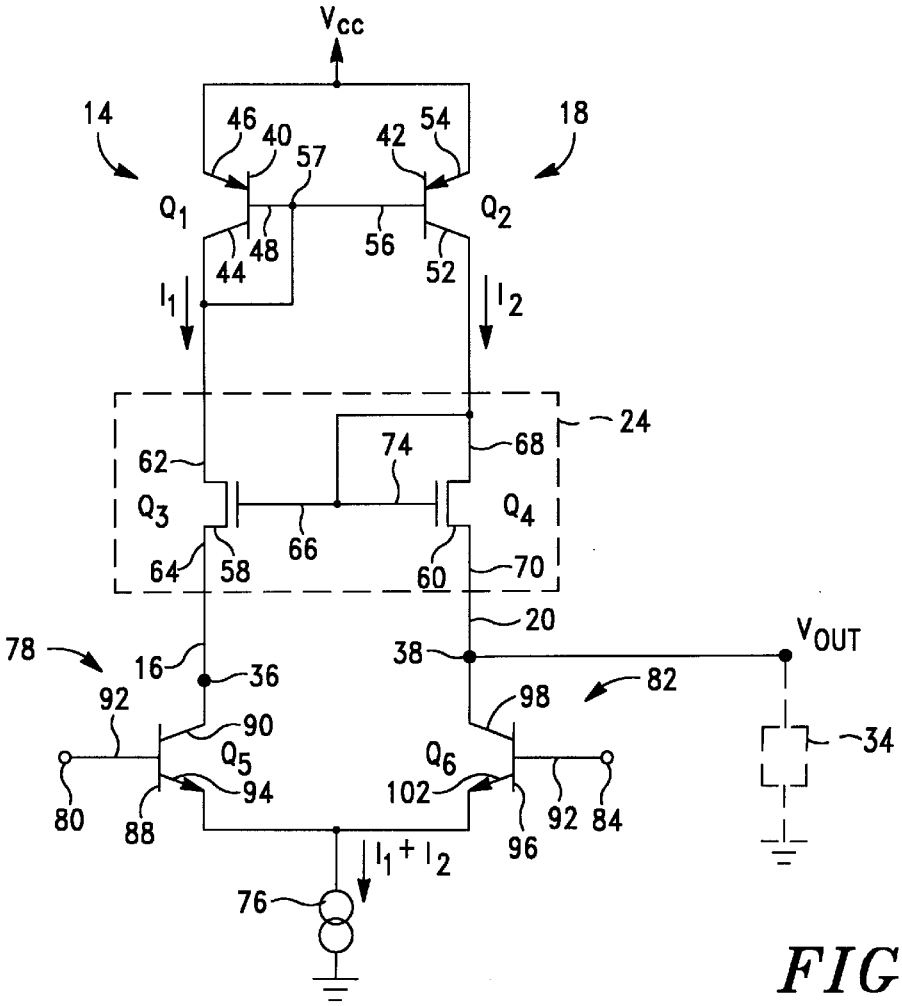
FIG. 4 is a schematic diagram of the current mirror circuit of FIG. 3.

Referring to FIG. 4, the first current control circuit 78 comprises an NPN transistor 88 indicated as Q5 having collector, base and emitter terminals 90, 92, 94, respectively. The second current control circuit 82 comprises an NPN transistor 96 indicated as Q6 having collector, base and emitter terminals 98, 100, 102, respectively. The collector 90 of the transistor Q5 is connected to the source 64 of the transistor Q3 and the collector 98 of the transistor Q6 is connected to the source 70 of the transistor Q4. The emitters 94, 102 of the transistors Q5 and Q6, respectively, are connected in common to the current sink 76. The base 92 of the transistor Q5 is biased via the node 80 to adjust the current flowing through the collector 90 of the transistor Q5, and the base 100 of the transistor Q6 is biased via the node 84 to adjust the current flowing through the collector 98 of the transistor Q6. The transistors Q5 and Q6 have substantially similar transconductances.

The balancing circuit 24 matches the impedance of the transistors Q5 and Q6 to one another. This is because the balancing circuit 24 provides the same voltage at the collectors 90, 98 of the transistors Q5 and Q6, respectively. If the bias voltage at the bases 92, 100 of the transistors Q5 and Q6 are the same, then equal levels of the currents $I_1$ and $I_2$ flow from the collectors to the emitters of the transistors Q5 and Q6, respectively. Therefore, in this embodiment, the first and second current paths 16, 20 carry the same level of the currents $I_1$ and $I_2$ for a range of output voltage levels $V_{OUT}$ at the nodes 36 and 38. The present invention can be utilized in any application where having balanced impedance for any output voltage is beneficial.

The above circuit can be coupled to a variable voltage load such as a capacitor. In applications where timing is achieved by charging and discharging capacitors through current sources, it is important that the currents be accurately mirrored regardless of the voltage on the capacitor. One such application includes voltage controlled oscillators (VCO). A VCO is a voltage to frequency converter. The current mirror circuit charges and discharges a capacitor used by the VCO for producing a frequency. The amount of current in the mirror current paths along with the capacity of the capacitor determine the VCO frequency. The current in the mirror current paths is in turn controlled by a voltage.

Figure 5:
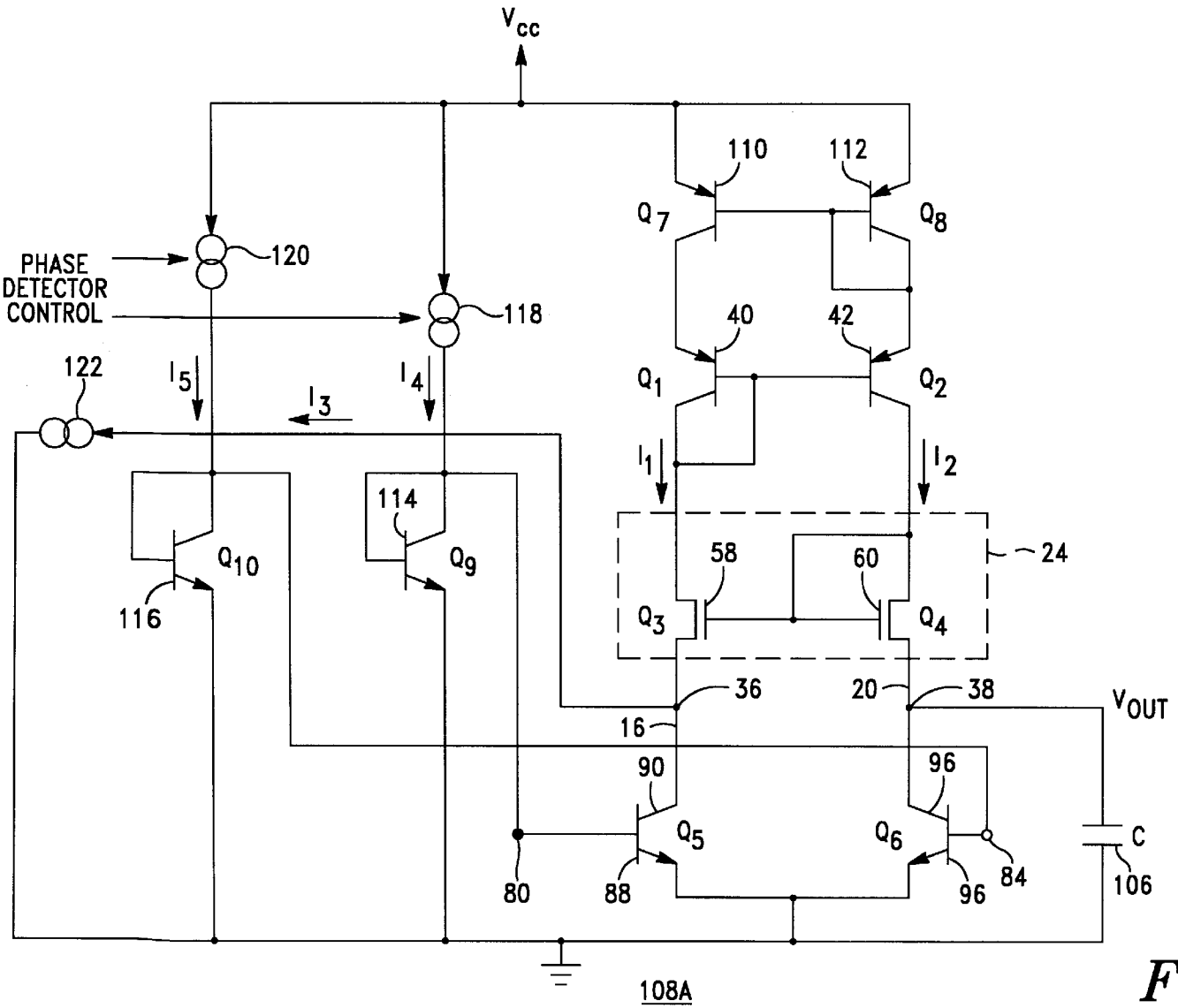
FIG. 5 is a schematic diagram of the example current mirror circuit of FIG. 4 interconnected to a capacitor.

An example implementation of the current mirror circuit 10, the balancing circuit 24, and the current control circuits 78, 82 for providing a current to charge a capacitor 106 in a partial VCO timing circuit 108*a* is shown in FIG. 5. In addition to the circuit components shown in FIG. 4 and described above, the VCO circuit 108*a* includes two PNP transistors 110, 112 indicated as Q7 and Q8, respectively, interconnected to the transistors Q1 and Q2 as shown. The transistors Q7 and Q8 provide matching of Betas as well as buffering the "Early" Effect for the mirror transistors Q1 and Q2.

The transistors Q7 and Q8 are shielded by transistors Q1 and Q2, so that the current flowing from the emitter to the collector of the transistor Q7 in the first current path 16 is the same as the current flowing from the emitter to the collector of the transistor Q8 in the second current path 20. This configuration causes the current flowing from the emitter to the collector of the transistor Q2 in the second current path 20 to be substantially the same as the current flowing from the emitter to the collector of the transistor Q1 in the first current path 16. Initially, the transistors Q7 and Q8 can be off whereby the mirror circuit 10 is in a stable condition. A startup current is introduced at the collector of the transistor Q2 to turn the transistors Q7 and Q8 on to conduct currents. Thereafter, the startup current is discontinued and prevented from influencing any portion of the circuit.

The transistors Q1, Q2, Q7 and Q8, interconnected as shown in FIG. 5, compensate for their base drive currents $I_B$. Since the bases of the transistors Q7 and Q8 are interconnected in common with the collector of the transistor Q8, the emitter currents, $I_E$, of the transistors Q7 and Q8 are the same. Similarly, the collector currents, $I_C$, of the transistors Q7 and Q8 are the same. Further, the collector current of the transistor Q1 is the same as its emitter current. Because the bases of transistors Q7 and Q8 are interconnected in common with the emitter of the transistor Q2, the emitter current of the transistor Q2 is equal to the sum of the base currents, $2I_B$, of the transistors Q7 and Q8 plus the collector current of the transistor Q8, $I_C$. Therefore, the collector current of the transistor Q1 in the first current path 16, $I_1=(I_C-I_B)+2I_B=I_C+I_B=I_E$. Similarly, the collector current of the transistor Q2 in the second current path 20, $I_2=(I_C+2I_B)-I_B=I_E$. Therefore, the current $I_1$ flowing through the first current path 16 is substantially the same as the current $I_2$ flowing in the second current path 20.

Two NPN transistors 114, 116 indicated as Q9 and Q10, respectively, are configured as diodes and interconnected to the bases 92, 100 of the transistors Q5 and Q6, respectively, to provide bias voltages to the transistors Q5 and Q6. The collector of the transistors Q9 and Q10 are connected to primary current generator 118, 120 respectively, which generate equal levels of currents $I_4$, $I_5$ at 100 $\mu$A . An idle current generator 122 is also interconnected to the first current path 16 to generate an idle current $I_3$ of 5 $\mu$A.

The idle current $I_3$ is applied to the first current path 16 and mirrored in the second current path 20 to charge the capacitor 106. The idle current $I_3$ is applied to the first current path 16 in the presence of two large but balanced primary currents of 100 $\mu$A. When charging the capacitor 106, as the capacitor voltage varies from a low to a high voltage, the balancing circuit 24 maintains the same relative voltage at the collectors 90, 98 of the NPN transistors Q5 and Q6, respectively. This prevents variation in the currents flowing through the transistors Q5 and Q6 due to the Early effect in the transistors Q5 and Q6. Otherwise, variations in the large currents $I_4$, $I_5$ (100 $\mu$A) flowing through the transistors Q5 and Q6 due to the Early effect, would swamp the 5 $\mu$A idle current mirroring, causing improper charging the capacitor 106 and inaccurate timing of the VCO.

The balancing circuit 24 maintains the same relative voltage on the collectors of NPN transistors Q5 and Q6. Since the primary current generators 118, 120 generate the same level of currents (100 $\mu$A), the transistors Q5 and Q6 balance the mirror transistors Q1 and Q2 to provide equal currents in the first and second current paths 16, 20. As such, in this example embodiment, the level of currents in the current paths 16, 20 is equal for output voltages of one $V_{BE}$ above ground to two $V_{BE}$ plus the MOS threshold of the transistor Q4, below the power supply $V_{CC}$.

Figure 6:
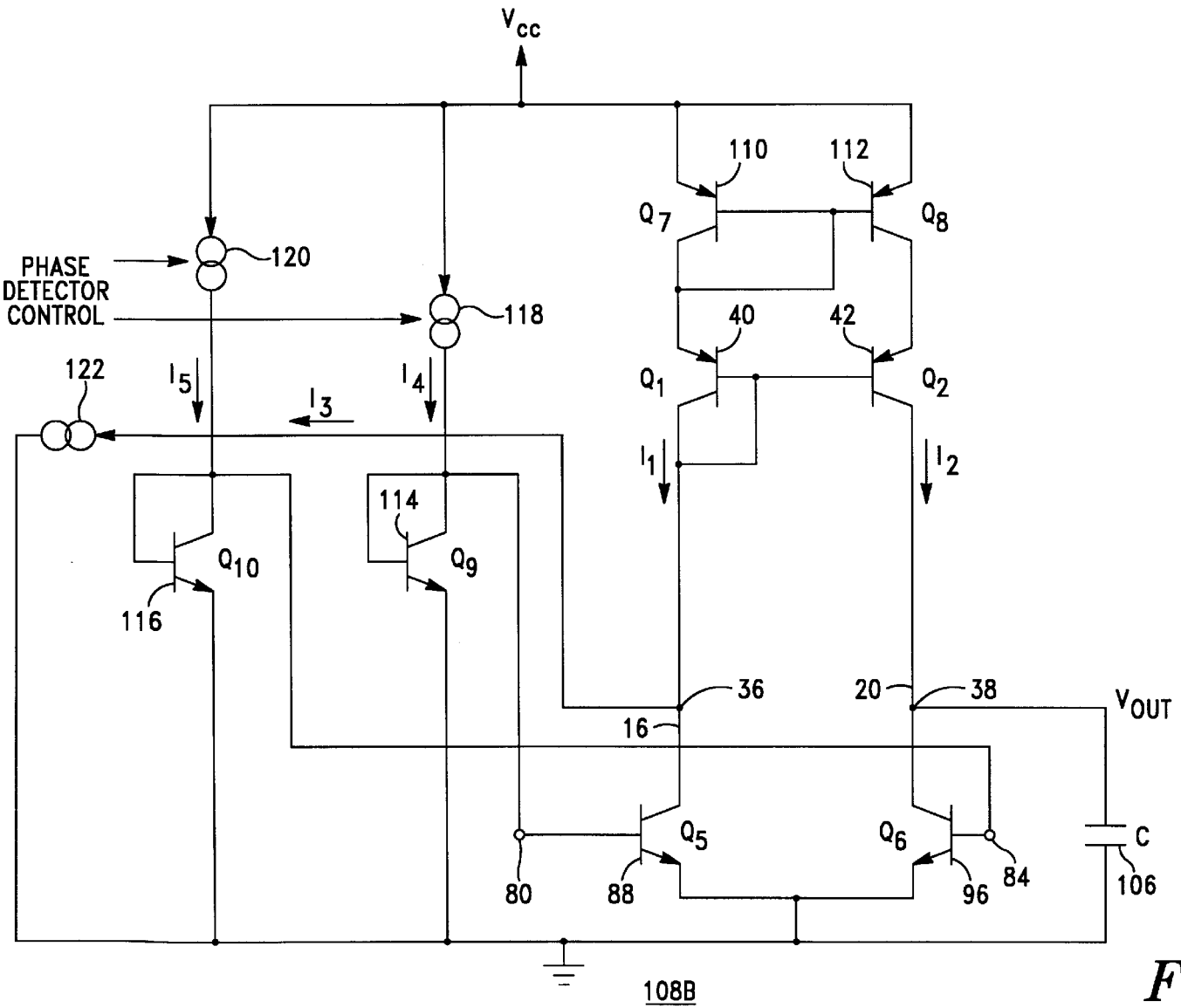
FIG. 6 shows a schematic of an example current mirror circuit without the balancing circuit of the present invention and with a conventional cascode.
Figure 7:
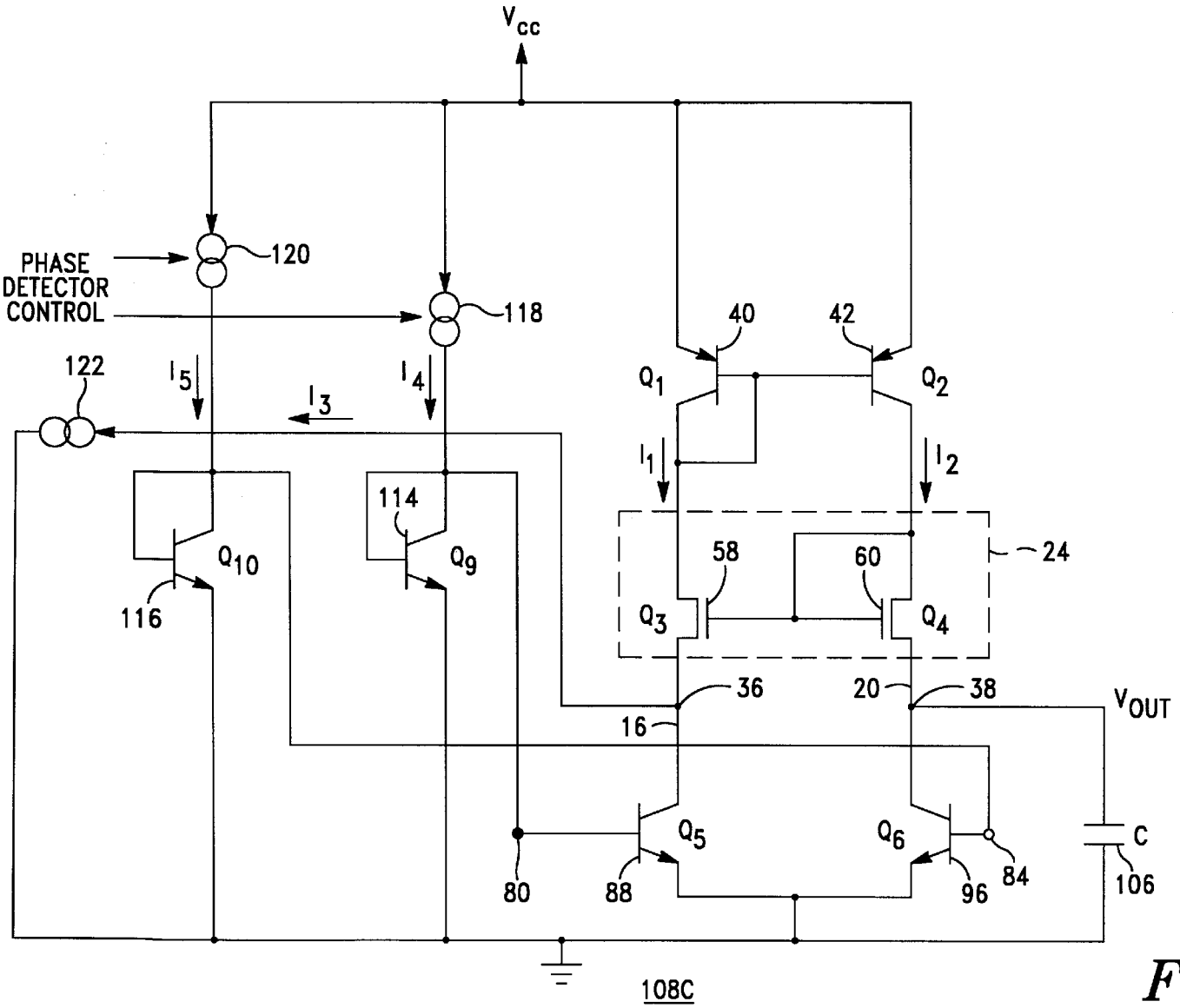
FIG. 7 shows a schematic of an example current mirror circuit including the balancing circuit of the present invention and without Beta compensation transistors.
Figure 8:
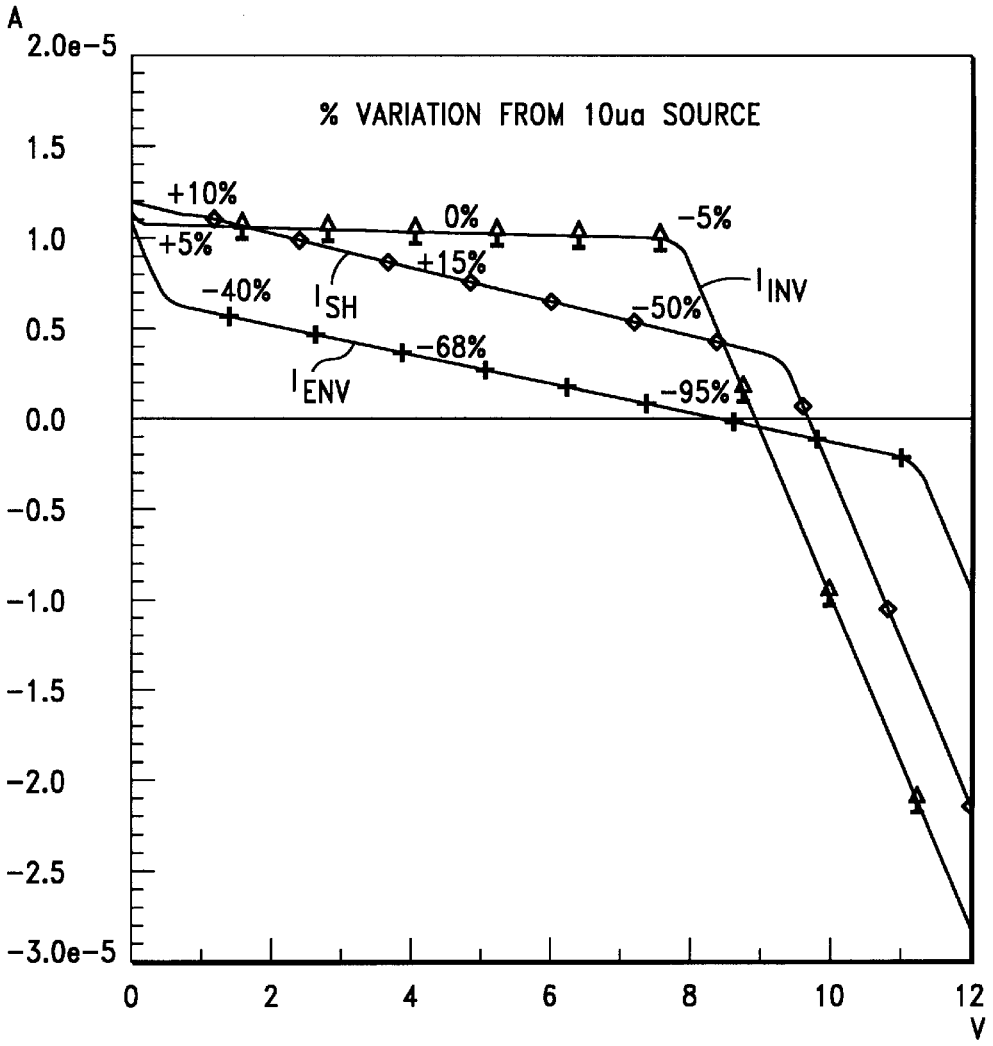
FIG. 8 shows three curves corresponding to the example current mirror circuits of FIGS. 5–7, each curve depicting simulation results for variations in a mirror current from a source current with varying output voltage.
Figure 9:
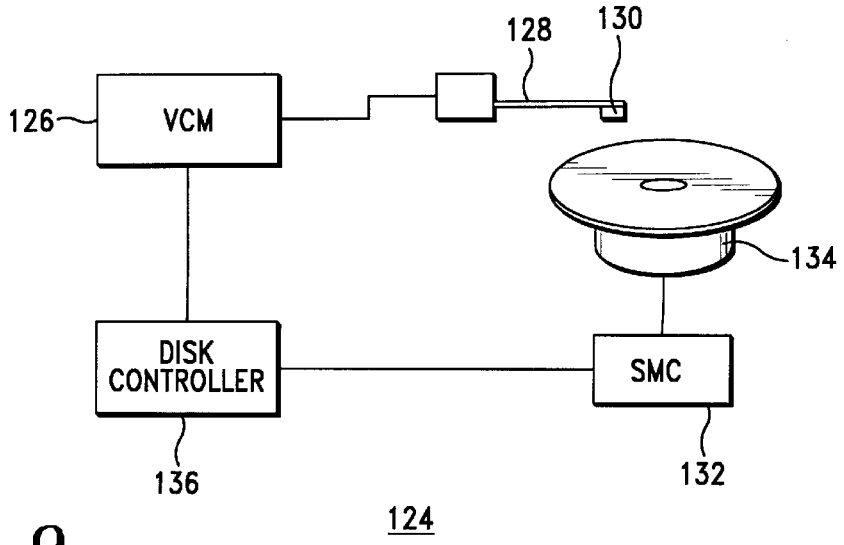
FIG. 9 is a block diagram of an example disk drive in which the current mirror circuit of the present invention can be implemented.

FIGS. 6 shows a schematic of an example current mirror circuit 108*b* without the balancing circuit 24 of the present invention and with the bases of the transistors Q7 and Q8 interconnected in common with the collector of the transistor Q7 as a conventional cascode. FIG. 7 shows a schematic of an example current mirror circuit 108*c* including the balancing circuit 24 of the present invention but without the transistors Q7 and Q8. FIG. 8 shows three curves $I_{INV}$, $I_{CNV}$ and $I_{SH}$ corresponding to the example current mirror circuits 108*a*, 108*b* and 108*c*, respectively, each curve depicting the simulation results for variations in the mirror current $I_2$ from the source current $I_1$=10 $\mu$A with $V_{OUT}$ ranging from about 0 volts to about 12 volts. The first curve, indicated as $I_{INV}$ corresponds to the current $I_2$ in the second current path 20 in the current mirror circuit 108*a* of FIG. 5. The second curve, indicated as $I_{CNV}$, corresponds to the current $I_2$ in the second current path 20 in the conventional current mirror circuit 108*b* of FIG. 6. The third curve, indicated as $I_{SH}$, corresponds to the current $I_2$ in the second current path 20 in the current mirror circuit 108*c* of FIG. 7.

The current mirror circuit 108*b* of FIG. 6 shows from about 40% to about 95% variation in $I_2$ ($I_{CNV}$) because the transistors Q5 and Q6 see different voltages at nodes 36, 38, respectively. The current mirror circuit 108*c* of FIG. 7 provides a substantial decrease in $I_2$ ($I_{SH}$) variations compared to the circuit 108*b* because the transistors Q5 and Q6 of the circuit 108*c* see substantially the same voltages at nodes 36, 38, respectively. However, in circuit 108*c* of FIG. 7, because the voltage at the collector of the transistor Q2 varies while the voltage at the collector of the transistor Q1 is fixed, there is from about +10% to about −50% variation in the current $I_2$ ($I_{SH}$). The circuit 108*a* of FIG. 5 provides a minimal variation of about +5% to about −5% in $I_2$ ($I_{INV}$) because the transistors Q5 and Q6 see substantially the same voltages at nodes 36, 38, respectively, and because the transistors Q7 and Q8 provide matching of Betas as well as buffering the "Early" Effect for the mirror transistors Q1 and Q2.

The VCO timing circuit 108*a* can be utilized in Phase Lock Loop commutation of Spindle Motor Controllers for disk drives. The idle current provides VCO timing at startup when not enough back emf (BEMF) is generated to control the VCO through a phase detectors (nor shown). In the circuit 108*a* of FIG. 5, signals from the phase detector control the current level generate by the two primary current generators 118, 120. Initially, the primary current generators 118, 120 are balanced and only the idle current $I_3$ controls the VCO timing. As the Spindle Motor spins up, the phase detector detects the differences of the BEMF in the spindle motor coils. These differences are reflected in the current generators 118, 120 which will then drive the VCO. FIG. 6, shows a block diagram of a disk drive 124 comprising a Voice Coil Motor (VCM) 126 for manipulating a head carrier arrn 128 bearing a read/write head 130, and a Spindle Motor Controller (SMC) 132 interconnected to a Spindle Motor 134 for commutating the Spindle Motor 134. The VCM 126 and the SMC 134 are interconnected to a disk controller 136 for performing read/write operations. The VCO circuit 108 including the current mirror circuit 10, balancing circuit 24 and current control circuits 78, 82 shown in FIGS. 4 and 5 can be included in the SMC 132 as analog ASIC to provide Spindle Motor commutations as described.

Although the present invention has been described in considerable detail with regard to the preferred versions thereof, other versions are possible. Therefore, the appended claims should not be limited to the descriptions of the preferred versions contained herein.

What is claimed is:

1. A current mirror circuit comprising:

(a) a first controller for providing a first current path, the controller comprising a current reference means for providing a control signal corresponding to the current level of the first current path;

(b) a second controller for providing a second current path, the second controller comprising current control means for controlling the level of current through the second current path in response to the control signal; and (c) a balancing circuit, connected in series with said current reference means in the first current path and with said current control means in the second current path, for substantially maintaining a ratio of the level of currents through the first and the second current paths by providing substantially the same relative reference voltage level at first and second reference locations in said first and second current paths, respectively, while allowing said reference voltage level to vary.

2. The current mirror circuit of claim 1 wherein the balancing circuit provides substantially the same impedance at said first and second reference locations to maintain substantially the same relative reference voltage level at said first and second reference locations while allowing said reference voltage level to vary.

3. The current mirror circuit of claim 1 wherein the balancing circuit comprises a first transistor in series with said current reference means in the first current path, and a second transistor in series with the current control means in the second current path, the second transistor coupled to the first transistor for maintaining said ratio of the current levels through the first and the second current paths by providing said relative reference voltage level while allowing the reference voltage level to vary.

4. The current mirror circuit of claim 3 wherein the first and the second transistors of the balancing circuit are biased so as to operate in their respective saturation regions.

5. The current mirror circuit of claim 1 wherein the first controller and the second controller each comprise transistors.

6. The current mirror circuit of claim 1 further comprising: (i) a current sink, (ii) a first current control circuit provided in the first current path in series between the balancing circuit and the current sink, for adjusting the level of current flowing through the first current path in response to a first command signal and (iii) a second current control circuit provided in the second current path in series between the balancing circuit and the current sink, for adjusting the level of current flowing through the second current path in response to a second command signal;

wherein each of the first and second current control circuits has an impedance varying with voltage, and wherein the balancing circuit substantially matches the impedance of the current control circuits by substantially maintaining said relative reference voltage level: (i) at the first reference location in the first current path between the balancing circuit and the first current control circuit and (ii) at the second reference location in the second current path between the balancing circuit and the second current control circuit, while allowing the reference voltage level to vary; thereby minimizing the difference in voltage at said first and second reference locations.

7. The current mirror circuit of claim 6 wherein the first current control circuit and the second current control circuit each comprise transistors, said transistors having substantially similar transconductances and impedances varying with voltage, and wherein the balancing circuit substantially matches the impedance of the transistors by maintaining the reference voltage level at said first and second reference locations.

8. A current mirror circuit comprising:

(a) a first controller for providing a first current path, the first controller comprising a first transistor having first, second and control tenninals, the control terminal providing a control signal corresponding to the current level of the first current path;

(b) a second controller for providing a second current path, the second controller comprising a second transistor having first, second and control terminals, the control terminals of the first and the second transistor coupled to one another for controlling the level of current through the second current path in response to the control signal; and (c) a balancing circuit, having a pair of input terminals and a pair of corresponding output terminals, provided in series in the first and second current paths by connecting one of the input terminals to the second terminal of the first transistor in the first current path and connecting the other input terminal to the second terminal of the second transistor in the second current path, the balancing circuit substantially maintaining a ratio of the level of currents through the first and the second current paths by providing substantially the same relative reference voltage level at said output terminals in the current paths while allowing said reference voltage level to vary.

9. The current mirror circuit of claim 8 wherein the balancing circuit provides substantially the same impedance in said current paths at said output terminals to maintain substantially the same relative reference voltage level in said current paths at said output terminals while allowing said reference voltage level to vary.

10. The current mirror circuit of claim 8 wherein the balancing circuit comprises third and fourth transistors each having first, second and control terminals, the first and second terminals of the third transistor connected in series with one of said input terminals and the corresponding output terminal in the first current path, respectively, the first and second terminals of the fourth transistor connected in series with another of said input terminals and the corresponding output terminal in the second current path, respectively, the control terminals of the third and the forth transistors being coupled in common to the first terminal of the fourth transistor for maintaining said ratio of the current levels through the first and the second current paths by providing said relative reference voltage level at said output terminals while allowing the reference voltage level to vary.

11. The current mirror circuit of claim 10 wherein the third and the fourth transistors of the balancing circuit are biased so as to operate in their respective saturation regions.

12. The current mirror circuit of claim 8 further comprising: (i) a current sink, (ii) a first current control circuit provided in the first current path in series between the balancing circuit and the current sink, for adjusting the level of current flowing through the first current path in response to a first command signal and (iii) a second current control circuit provided in the second current path in series between the balancing circuit and the current sink, for adjusting the level of current flowing through the second current path in response to a second command signal;

wherein each of the first and second current control circuits has an impedance varying with voltage, and wherein the balancing circuit substantially matches the impedance of the current control circuits by maintaining said relative reference voltage level at said output terminals in the current paths while allowing said reference voltage level to vary.

13. The current mirror circuit of claim 12 wherein the first and the second current control circuits each comprise transistors, said transistors having substantially similar transconductances and impedances varying with voltage and wherein the balancing circuit matches the impedance of the transistors by maintaining the reference voltage at said output terminals.

14. A current mirror circuit operating from a source voltage level, comprising:

(a) a first controller for providing a first current path, the controller comprising a current reference means for providing a control signal corresponding to the current level of the first current path with respect to a reference voltage level, the reference voltage level being proportional to the source voltage level;

(b) a second controller for providing a second current path, the second controller comprising current control means for controlling the level of current through the second current path in response to the control signal with respect to the reference voltage level; and (c) a balancing circuit, connected in series with said current reference means in the first current path and with said current control means in the second current path, for: (1) substantially maintaining a ratio of the levels of the currents through the first and the second current paths and (2) providing the reference voltage level at first and second reference locations in said first and second current paths, respectively, while allowing the reference voltage level to vary.

15. The current mirror circuit of claim 14 wherein the balancing circuit comprises a first transistor in series with said current reference means in the first current path, and a second transistor in series with the current control means in the second current path, the second transistor coupled to the first transistor for: (1) substantially maintaining a ratio of the levels of the currents through the first and the second current paths and (2) providing said reference voltage level at said first and second reference locations while allowing said reference voltage level to vary.

16. The current mirror circuit of claim 15 wherein the first and the second transistors of the balancing circuit are biased so as to operate in their respective saturation regions.

17. The current mirror circuit of claim 14 further comprising: (i) a current sink having a first terminal at said source voltage level and a second terminal, (ii) a first current control circuit provided in the first current path in series between the balancing circuit and the second terminal of the current sink, for adjusting the level of current flowing through the first current path in response to a first command signal and (iii) a second current control circuit provided in the second current path in series between the balancing circuit and the second terminal of the current sink, for adjusting the level of current flowing through the second current path in response to a second command signal;

wherein each of the first and second current control circuits has an impedance varying with voltage, and wherein the balancing circuit substantially matches the impedance of the current control circuits by substantially maintaining the reference voltage level: (i) at the first reference location in the first current path between the balancing circuit and the first current control circuit and (ii) at the second reference location in the second current path between the balancing circuit and the second current control circuit, while allowing the reference voltage level to vary; thereby minimizing the difference in voltage at said first and second locations.

18. The current mirror circuit of claim 17 wherein the first current control circuit and the second current control circuit each comprise transistors, said transistors having substantially similar transconductances and impedances varying with voltage, and wherein the balancing circuit substantially matches the impedance of the transistors by maintaining the reference voltage level at said first and second reference locations.

19. The current mirror circuit of claim 14 wherein the first controller and the second controller each comprise transistors.

20. A current mirror circuit operating from a source voltage level, comprising:

(a) a first controller for providing a first current path, the controller comprising a first transistor having first, second and control terminals, the control terminal providing a control signal corresponding to the current level of the first current path with respect to a reference voltage level, the reference voltage level being proportional to the source voltage level;

(b) a second controller for providing a second current path, the second controller comprising a second transistor having first, second and control terminals, the control terminals of the first and the second transistor coupled to one another for controlling the level of current through the second current path in response to the control signal with respect to the reference voltage level; and (c) a balancing circuit, having a pair of input terminals and a pair of corresponding output terminals, provided in series in the first and second current paths by connecting one of the input terminals to the second terminal of the first transistor in the first current path and connecting the other input terminal to the second terminal of the second transistor in the second current path, the balancing circuit substantially maintaining a ratio of the level of currents through the first and the second current paths by providing substantially the same relative reference voltage level at said output terminals in the current paths while allowing said reference voltage level to vary.

21. The current mirror circuit of claim 20 wherein the balancing circuit comprises third and fourth transistors each having first, second and control terminals, the first and second terminals of the third transistor connected in series with one of said input terminals and the corresponding output terminal in the first current path, respectively, the first and second terminals of the fourth transistor connected in series with another of said input terminals and the corresponding output terminal in the second current path, respectively, the control terminals of the third and the forth transistors being coupled in common to the first terminal of the fourth transistor for maintaining said ratio of the current levels through the first and the second current paths by substantially providing said relative reference voltage level at said output terminals while allowing the reference voltage level to vary.

22. The current mirror circuit of claim 21 wherein the third and the fourth transistors of the balancing circuit are biased so as to operate in their respective saturation regions.

23. The current mirror circuit of claim 20 further comprising: (i) a current sink having a first terminal at said source voltage level and a second terminal, (ii) a first current control circuit provided in series in the first current path between the balancing circuit and the second terminal of the current sink, for adjusting the level of current flowing through the first current path in response to a first command signal and (iii) a second current control circuit provided in the second current path in series between the balancing circuit and the second terminal of the current sink, for adjusting the level of current flowing through the second current path in response to a second command signal;

wherein each of the first and second current control circuits has an impedance varying with voltage, and wherein the balancing circuit substantially matches the impedance of the current control circuits by maintaining said relative reference voltage level AT said output terminals in the current paths while allowing said reference voltage level to vary.

24. The current mirror circuit of claim 23 wherein the first and the second current control circuits each comprise transistors, said transistors having substantially similar transconductances and impedances varying with voltage, and wherein the balancing circuit matches the impedance of the transistors by substantially maintaining the reference voltage level at said output terminals.

25. The current mirror circuit of claim 20 wherein the balancing circuit provides substantially the same impedance at said output terminals in said current paths to maintain the same relative reference voltage level in said current paths at said output terminals while allowing said reference voltage level to vary.

26. A balancing controller for balancing mirror currents in a current mirror circuit including a first controller for providing a first current path, the first controller comprising a current reference means for providing a control signal corresponding to the current level of the first current path, and a second controller for providing a second current path, the second controller comprising current control means for controlling the level of current through the second current path in response to the control signal, the balancing controller comprising a balancing circuit, connected in series with said current reference means in the first current path and with said current control means in the second current path, for substantially maintaining a ratio of the level of currents through the first and the second current paths by providing substantially the same relative reference voltage level at first and second reference locations in said first and second current paths, respectively, while allowing said reference voltage level to vary.

27. The balancing controller of claim 26 wherein the balancing circuit provides substantially the same impedance at said first and second reference locations to substantially maintain the same relative reference voltage level at said first and second reference locations while allowing said reference voltage level to vary.

28. The balancing controller of claim 26 wherein the balancing circuit comprises a first transistor in series with said current reference means in the first current path, and a second transistor in series with the current control means in the second current path, the second transistor coupled to the first transistor for substantially maintaining said ratio of the current levels through the first and the second current paths by substantially providing said relative reference voltage level while allowing the reference voltage level to vary.

29. The balancing controller of claim 28 wherein the first and the second transistors of the balancing circuit are biased so as to operate in their respective saturation regions.

30. The balancing controller of claim 26 wherein the first controller and the second controller each comprise transistors.

31. The balancing controller of claim 26 wherein the current mirror circuit further comprises: (i) a current sink, (ii) a first current control circuit provided in the first current path in series between the balancing circuit and the current sink, for adjusting the level of current flowing through the first current path in response to a first command signal and (iii) a second current control circuit provided in the second current path in series between the balancing circuit and the current sink, for adjusting the level of current flowing through the second current path in response to a second command signal;

wherein each of the first and second current control circuits has an impedance varying with voltage, and wherein the balancing circuit matches the impedance of the current control circuits by substantially maintaining said relative reference voltage level: (i) at the first reference location in the first current path between the balancing circuit and the first current control circuit and (ii) at the second reference location in the second current path between the balancing circuit and the second current control circuit, while allowing the reference voltage level to vary; thereby minimizing the difference in voltage at said first and second reference locations.

32. The balancing controller of claim 31 wherein the first current control circuit and the second current control circuit each comprise transistors, said transistors having substantially similar transconductances and impedances varying with voltage, and wherein the balancing circuit substantially matches the impedance of the transistors by maintaining the reference voltage level at said first and second reference locations.

* * * * *